US007371269B2

(12) United States Patent
Kawasaki

(10) Patent No.: US 7,371,269 B2
(45) Date of Patent: May 13, 2008

(54) ELECTROMAGNETIC VIBRATING PUMP

(75) Inventor: Nozomu Kawasaki, Takatsuki (JP)

(73) Assignee: Techno Takatsuki Co., Ltd., Takatsuki-shi (JP)

( * ) Notice: Subject to any disclaimer, the term of this patent is extended or adjusted under 35 U.S.C. 154(b) by 425 days.

(21) Appl. No.: 11/022,947

(22) Filed: Dec. 28, 2004

(65) Prior Publication Data

US 2006/0140786 A1 Jun. 29, 2006

(51) Int. Cl.
*B01D 45/12* (2006.01)

(52) U.S. Cl. ..... 55/459.1; 417/313; 417/423.9

(58) Field of Classification Search ..... 55/337, 55/346, 349, 385.1, 426, 459.1, 467; 417/313, 417/410.1, 413.1, 423.9
See application file for complete search history.

(56) References Cited

U.S. PATENT DOCUMENTS

| | | | | |
|---|---|---|---|---|
| 4,731,101 | A | 3/1988 | Kanda | 55/323 |
| 5,815,881 | A * | 10/1998 | Sjogreen | 15/321 |
| 6,625,845 | B2 | 9/2003 | Matsumoto et al. | 15/353 |
| 6,928,692 | B2 | 8/2005 | Oh et al. | |

FOREIGN PATENT DOCUMENTS

| | | |
|---|---|---|
| JP | 56-161852 | 12/1981 |
| JP | 62-66755 | 4/1987 |
| JP | 5-131158 | 5/1993 |
| JP | 5-168980 | 7/1993 |
| JP | 8-270556 | 10/1996 |
| JP | 10-263326 | 10/1998 |
| JP | 10-318148 | 12/1998 |
| JP | 2001-121039 | 5/2001 |
| JP | 3223412 | 8/2001 |
| JP | 2003-511180 | 3/2003 |
| JP | 2003-325402 | 11/2003 |
| KR | 2001-0090527 | 10/1921 |
| WO | WO 01/28400 A1 | 4/2001 |

OTHER PUBLICATIONS

International Search Report for corresponding PCT International Application No. PCT/JP03/15127, dated Feb. 3, 2005.
Japanese Office Action dated Dec. 25, 2007, including partial English translation.
Korean Office Action dated Jan. 15, 2008.

* cited by examiner

*Primary Examiner*—Robert A. Hopkins
(74) *Attorney, Agent, or Firm*—Kratz, Quintos & Hanson, LLP

(57) ABSTRACT

The object of the present invention is to provide an electromagnetic vibrating pump which can enhance dust collecting function, reduce the number of times of maintenance working and improve the rate of operation. The present invention is an electromagnetic vibrating pump, having a suction orifice sucking air and vent orifices venting said air in an internal cyclone chamber and equipped with a centrifugal dust collector having a cyclone generating portion at which a generating portion for generating cyclone action to the atmosphere which was sucked in the cyclone chamber through said suction orifice is provided.

16 Claims, 22 Drawing Sheets

ELECTROMAGNETIC VIBRATING PUMP

TECHNICAL FIELD

The present invention relates to an electromagnetic vibrating pump. More particularly, the present invention relates to an electromagnetic vibrating pump which is mainly utilized for sucking and venting air to an air mat for an interior and an air bed, for supplementing oxygen in such as a water tank for fish firming and a septic tank for domestic use, or for sampling an examination gas in pollution control.

BACKGROUND OF THE INVENTION

As an electromagnetic vibrating pump for sucking and discharging a fluid utilizing the vibration of a vibrator which is equipped with a permanent magnet based on magnetic interaction of an electromagnet and the permanent magnet, there has been conventionally a pump described in FIG. 21 (for example, Japanese Unexamined Patent Publication No. 270556/1996).

The pump is a diaphragm pump and composed of an electromagnet which is arranged facing a frame in a pump frame body 200, a vibrator equipped with a permanent magnet, a diaphragm linked with both ends of the vibrator and pump casing portions which are respectively fixed at both end sides of the above-mentioned frame. Further, the upper portion of the above-mentioned pump frame body 200 is provided with a dust collecting portion 201 for removing such as sand dust and dust in the air and for sucking air. As shown in FIG. 22, the dust collecting portion 201 is composed of a filter 203 which is made of a non-woven cloth of a synthetic fiber and provided in turn in a nearly square or nearly circular dust collecting chamber 202 which is formed in the pump frame body 200, two divisional filter packings 204 and a filter cover 205. Further, a sucking orifice for sucking air is provided at the bottom portion of the above-mentioned dust collecting chamber 202 and an intake 206 of air of the atmosphere is formed between the two divisional filter packings 204 covered with the filter cover 205.

In such arrangement, after air of the atmosphere is sucked from the intake 206, dust is collected with the filter 203, and then the air flows in the pump chamber of the above-mentioned pump casing portions. However, fine dust and fine sand dust which pass the filter 203 cannot be completely removed. Accordingly, there has been a problem that fine sands which pass the filter enter into a gap between a diaphragm being used for a pump and a metal fitting retaining the diaphragm, and the diaphragm is damaged during operation and its life time is shortened. Further, there has been a problem that the number of times of maintenance working for exchanging the diaphragm is increased and the rate of operation of the pump is lowered.

DISCLOSURE OF THE INVENTION

Under the above-mentioned circumstances, it is an object of the present invention to provide an electromagnetic vibrating pump which can enhance dust collecting function, reduce the number of times of maintenance working and improve the rate of operation.

The electromagnetic vibrating pump of the present invention is an electromagnetic vibrating pump having a suction orifice which sucks air and vent orifices which vents the air in an internal cyclone chamber and equipped with a centrifugal dust collector having a cyclone generating portion at which a generating portion for generating cyclone action to the atmosphere being sucked in the cyclone chamber through said suction orifice is provided.

BEST MODE FOR CARRYING OUT OF THE INVENTION

The electromagnetic vibrating pump of the present invention is illustrated below based on the attached drawings.

Embodiment 1

Figure 1:
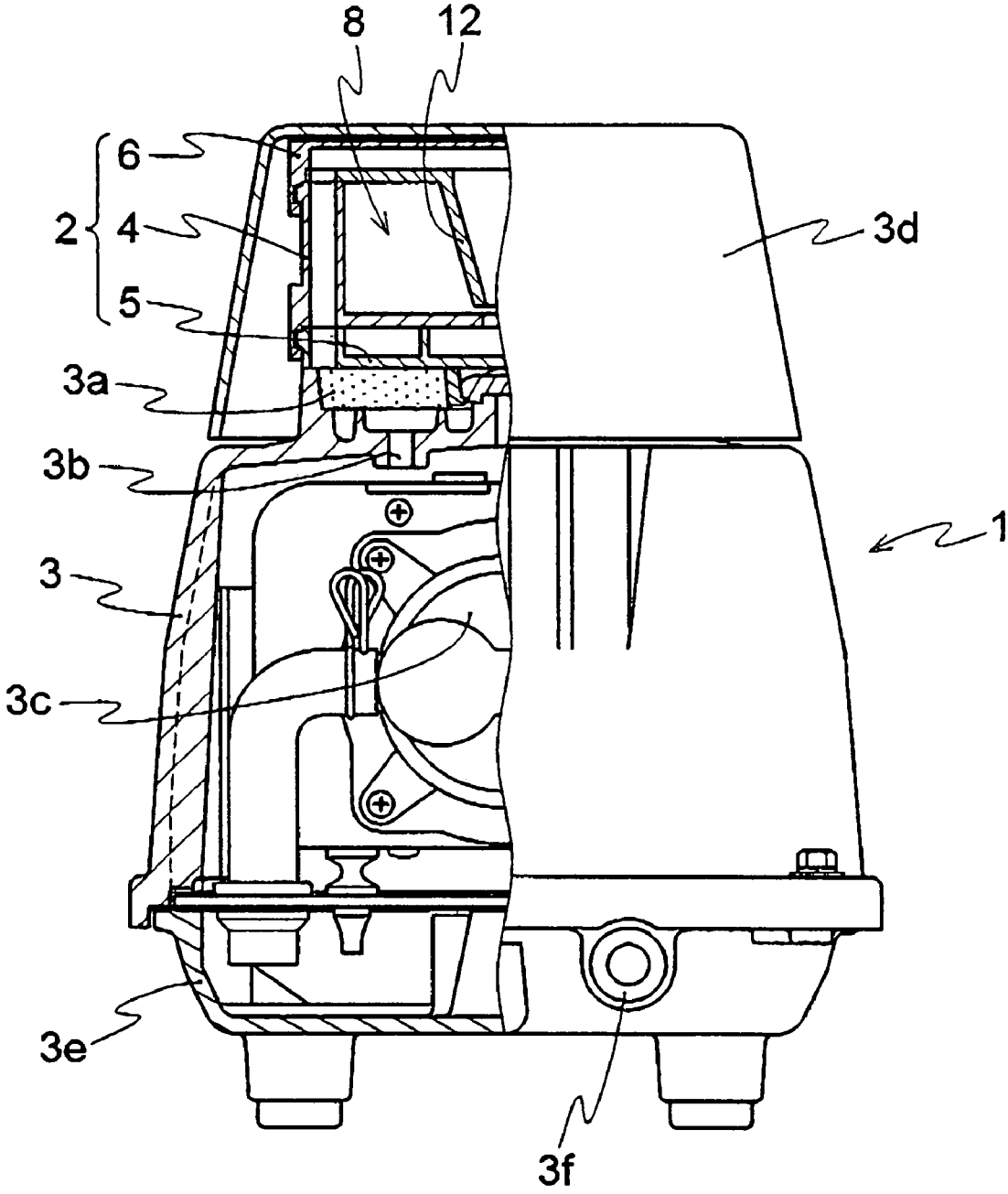
FIG. 1 is a side view showing an electromagnetic vibrating pump related to Embodiment 1 of the present invention.
Figure 2:
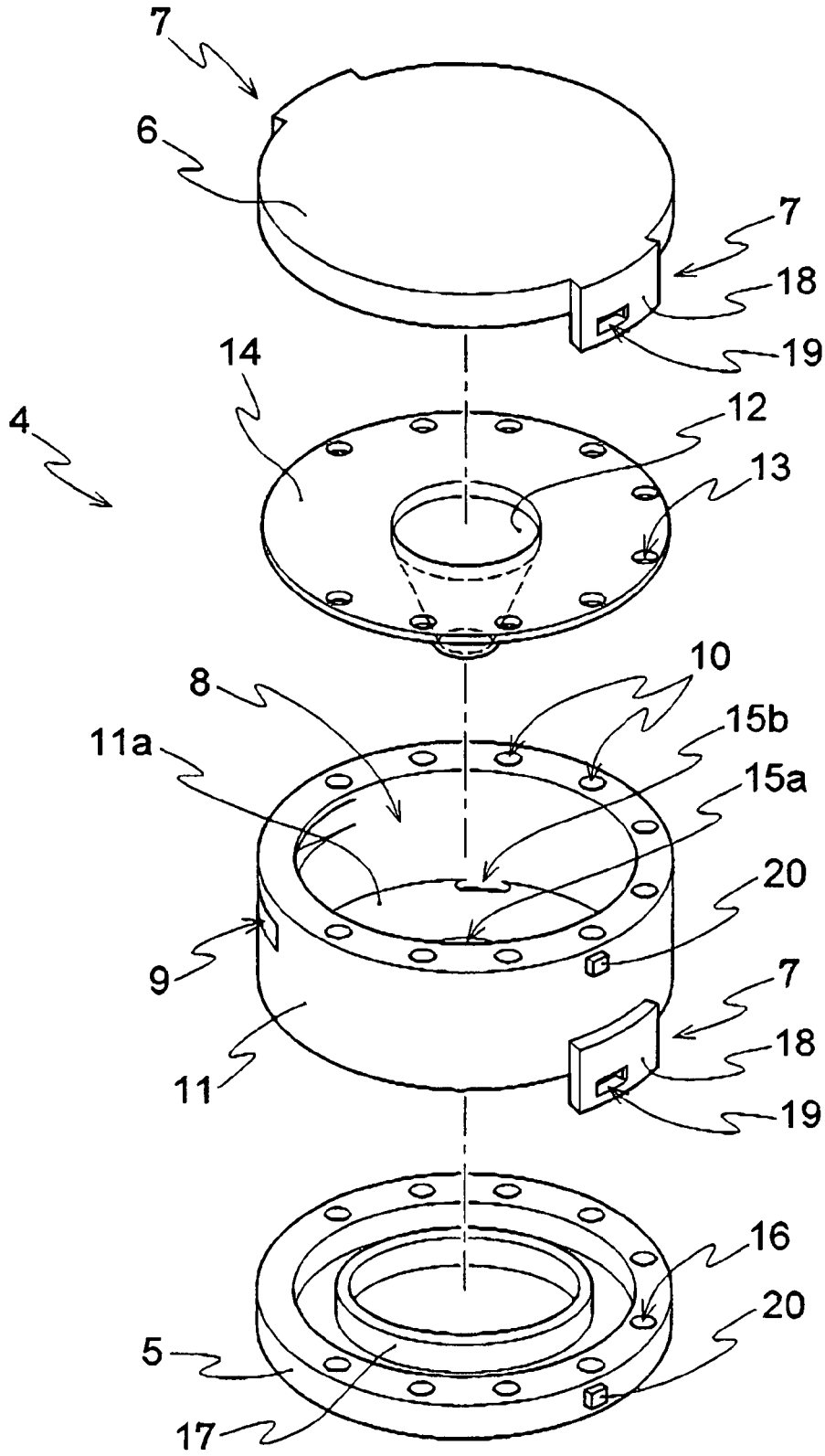
FIG. 2 is an exploded perspective view of the centrifugal dust collector of FIG. 1.

As shown in FIGS. 1 and 2, the electromagnetic vibrating type diaphragm pump related to Embodiment 1 of the present invention is a pump in which a centrifugal dust collector 2 is installed in the pump 1. Namely, in the centrifugal dust collector 2, vent orifices 10, 13 and 16, which are described later, are directly formed at the intake of the atmosphere of a pump frame body 3 or conventionally at the pump frame body 3. The kind of the pump 1 is not specifically limited, but in the present Embodiment 1, there is used a pump which is composed of an electromagnet facing the main body of a pump provided in the pump frame body 3, a vibrator equipped with a magnet, a diaphragm linked with both ends of said vibrator and a pump casing portion 3*c* having a pump chamber which is fixed at both end sides of the above-mentioned electromagnet. The above-mentioned electromagnet can be a two dimensional electromagnet or a steric electromagnet. For example, when it is the two dimensional electromagnet, the electromagnet is composed of a pair of E-type iron cores (main iron core) and a winding coil portion which is assembled in the inner peripheral concave portion of respective iron cores. When the two dimensional electromagnet is used, the shape of the magnet of the vibrator inserted into the cavity portion between the above-mentioned electromagnets becomes a tabular shape. Further, when it is the steric electromagnet, the electromagnet is composed of a pair of E-type iron cores with a small diameter (auxiliary iron core) which are arranged facing each other, a pair of E-type iron cores with a large diameter (main iron core) which are arranged at a position orthogonal to said pair of E-type iron cores with a small diameter and the winding coil portion which is assembled in the inner peripheral concave portion of said E-type iron cores with a large diameter. When the steric electromagnet is used, the magnetic shape of the vibrator is a steric shape. Such pump sucks and discharges a fluid utilizing the vibration of the vibrator equipped with the magnet based on the magnetic interaction of the above-mentioned electromagnet and magnet. In FIG. 1, Numerals 3*d*, 3*e* and 3*f* are respectively the cover of a dust collector, a vent tank and a discharge tank.

The above-mentioned centrifugal dust collector 2 is composed of a cyclone generating portion 4, a dust storing portion 5 which is installed at the lower portion of the cyclone generating portion 4 and an upper portion cover 6 which is installed at the upper portion of the above-mentioned cyclone generating portion 4. Further, the cyclone generating portion 4, the dust storing portion 5 and the upper portion cover 6 are detachably provided by a fitting portion 7.

Figure 3:
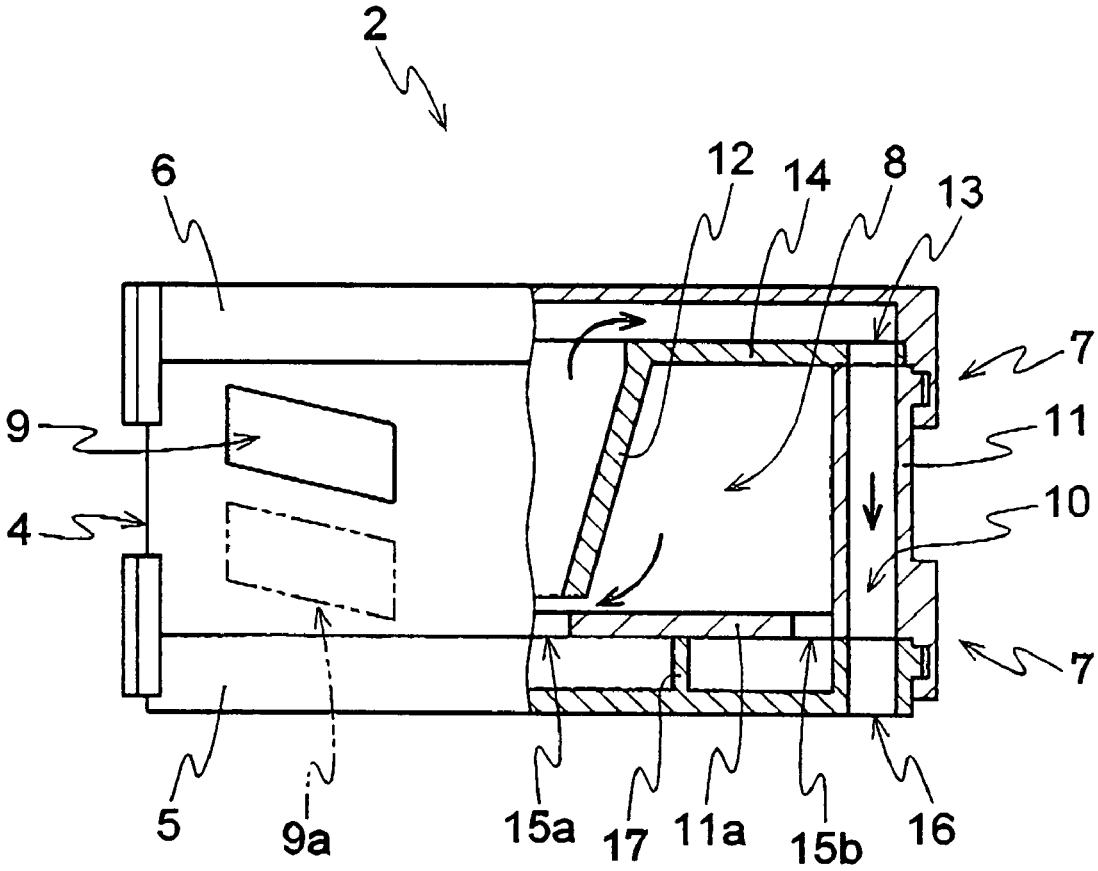
FIG. 3 is an essential sectional view of the centrifugal dust collector of FIG. 1.
Figure 4:
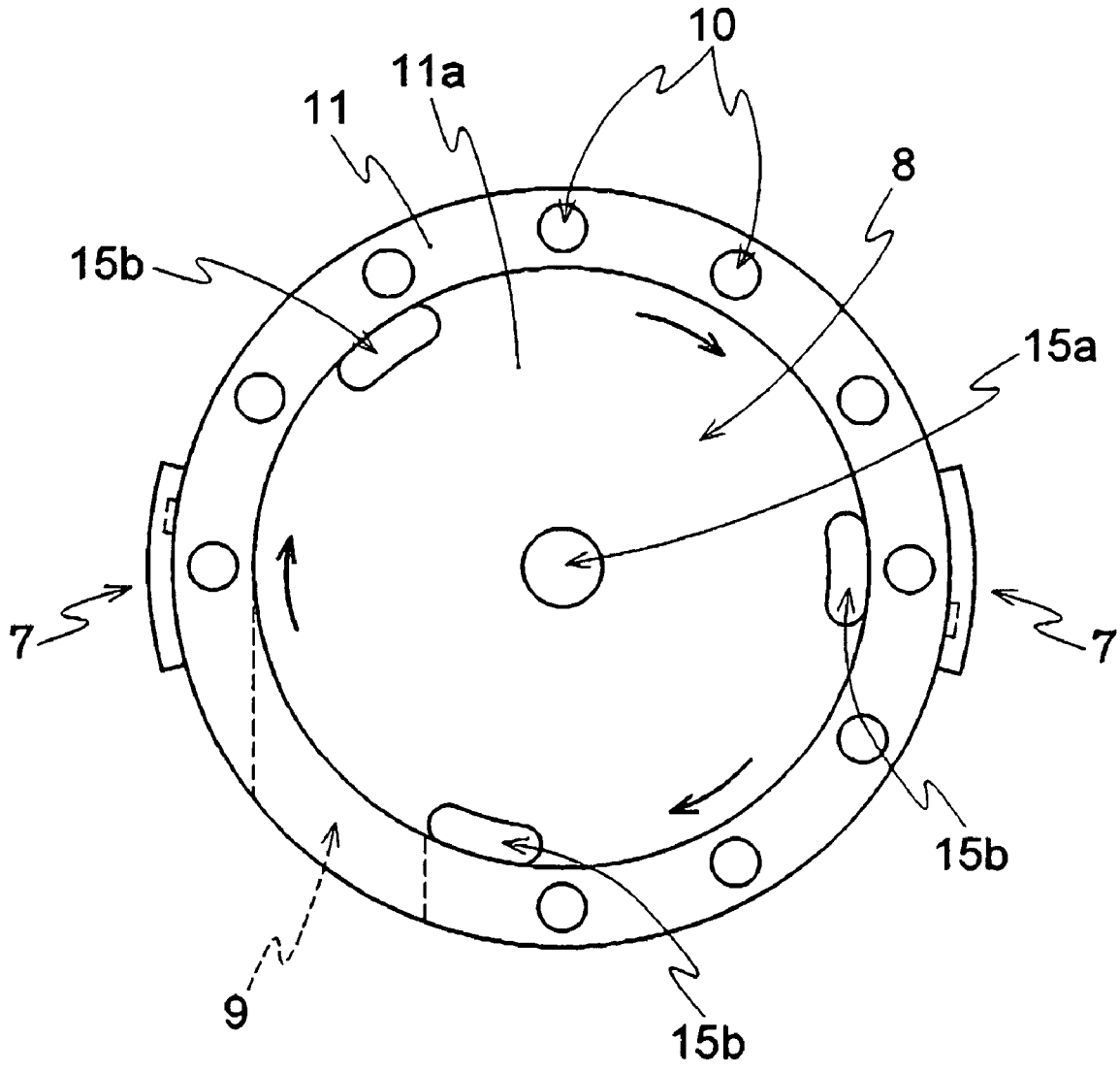
FIG. 4 is a plan view of the main body of the centrifugal dust collector of FIG. 1.

As shown in FIGS. 2 to 4, the above-mentioned cyclone generating portion 4 has a suction orifice 9 for sucking the atmosphere in a circular inside cyclone chamber 8 and a vent orifice 10 for venting said atmosphere to the pump side. Further, there is provided a generating portion for generating cyclone action to the atmosphere sucked in the cyclone chamber 8 from the suction orifice 9. Further, in FIGS. 3 and 4, the arrow mark shows the flow of air. In Embodiment 1, although the suction orifice 9 is formed at the upper portion of the cyclone chamber 8, it may be formed at the position 9*a* at the lower portion of the cyclone chamber 8. When the suction orifice 9 is opened at the upper position, for example, dust or sand dust in the atmosphere which is sucked at the upper portion can be dropped to the bottom portion of the cyclone chamber 8 with a high flow rate to collect the dust at the dust storing portion 5. Further, when the suction orifice 9 is opened at the lower position, dust or sand dust in the atmosphere which is sucked at the lower portion can be blown up to the upper portion side of the cyclone chamber 8 with a low flow rate and then dust or sand dust is easily dropped in the bottom portion of the cyclone chamber 8 because of a low flow rate, thereby the dust can be collected at the dust storing portion 5. The opening shape of the above-mentioned suction orifice 9 is nearly rectangular and its outlet is directed to the peripheral direction of the cyclone chamber 8. The above-mentioned opening shape is not always limited to be nearly rectangular, but can be also a long circular shape, a rhomb or a trapezoid. Further, the above-mentioned opening shape is preferably slanted so as to reduce an opening area to the cyclone chamber 8 in order to enhance the flow rate of sucked air.

The above-mentioned cyclone generating portion 4 is composed of a main body 11 in which a plural number of vent orifices 10 are formed at the above-mentioned outer peripheral site and a partitioning plate 14 in which a conical portion 12 being the above-mentioned generating portion and vent orifices 13 are formed at the same outer peripheral site as the above-mentioned vent orifices 10. Further, holes 15*a* and 15*b* for dropping sand dust or aliens are respectively formed at three positions of the position facing the above-mentioned conical portion 12 and the outer periphery of the cyclone chamber 8 so as to be linked with the above-mentioned dust storing portion 5, at the bottom portion 11*a* of the cyclone generating portion 4. The central hole 15*a* is formed so that when air circulation in the cyclone chamber 8 flows into the conical portion 12, fine dust which could not be captured by the outer peripheral holes 15*b* are dropped and air with high cleanliness is fed at the pump 1 side. The smaller the gap S1 between the upper surface position of the central hole 15*a* and the edge of the conical portion 12, the better, however it may be 0.5 to 10 mm and preferably 1 to 5 mm. Further, although one central hole 15*a* and three outer peripheral holes 15*b* are formed at the above-mentioned bottom portion 11*a* in Embodiment 1, at least one of these holes 15*a* and 15*b* can collect sand dust and aliens at the dust storing portion 5 side.

In the above-mentioned dust storing portion 5, vent orifices 16 are provided at the same outer peripheral site as the above-mentioned vent orifices 10, and a columnar rib 17 is provided at the inner face of the bottom portion. The columnar rib 17 is provided for preventing reverse flow but can be abbreviated.

The above-mentioned fitting portion 7 is not specifically limited as far as it is detachable. In Embodiment 1, there is formed a uneven fitting portion by an uneven structure comprising the concave portion 19 of a projection piece 18 of the upper portion cover 6 and the main body 11 and the convex portion 20 of the side face of the main body 11 and the dust cover 5. It may be a fitting portion by coupling with a screw other than the uneven fitting portion, but in this case, an assembly time becomes longer than the assembly time of the uneven fitting portion.

In Embodiment 1, due to the vibration of the vibrator based on the magnetic interaction of the above-mentioned electromagnet and magnet, dust floating in the air circulation flow of the atmosphere sucked from the suction orifice 9 is separated from the air flow during movement to the peripheral direction of the cyclone chamber 8 by the cyclone action (centrifugal action) and collected in the dust storing portion 5 from the outer peripheral hole 15*b* and the central hole 15*a*.

As a result, clean air is fed to the pump chamber of the pump 1 through the vent orifices 13, 10 and 16 from the inside of the conical portion 12.

Embodiment 2

Figure 5:
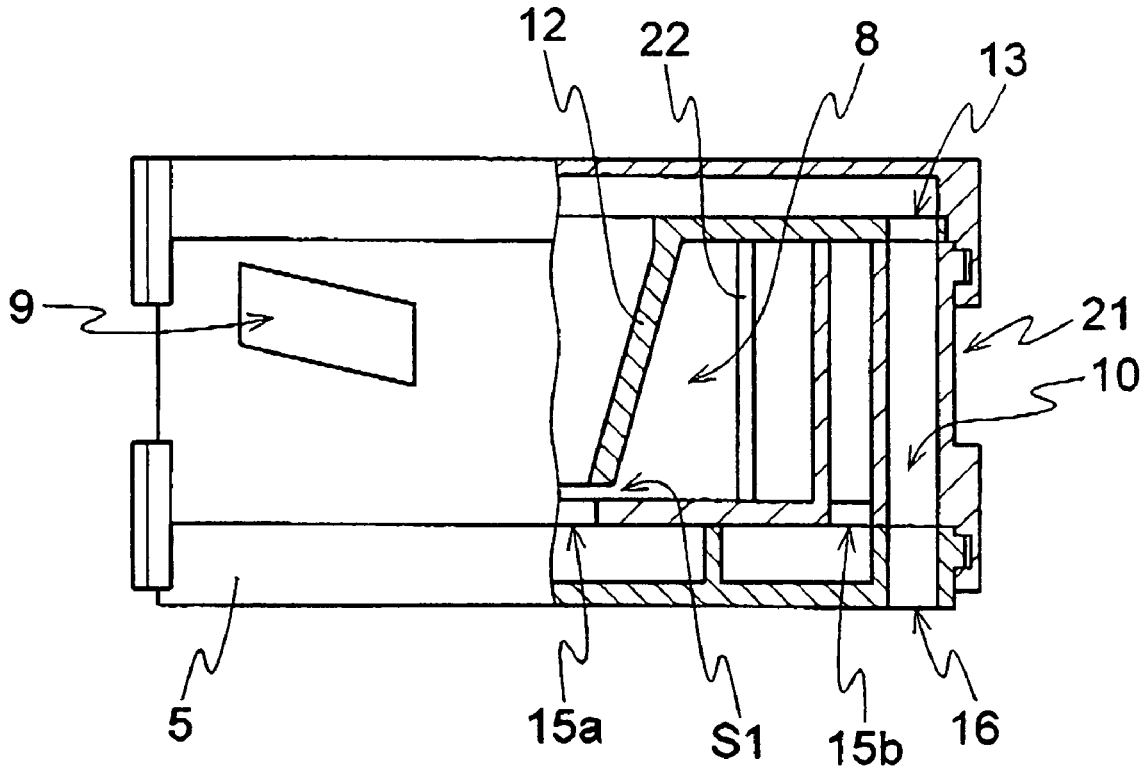
FIG. 5 is an essential sectional view showing the centrifugal dust collector related to Embodiment 2 of the present invention.
Figure 6:
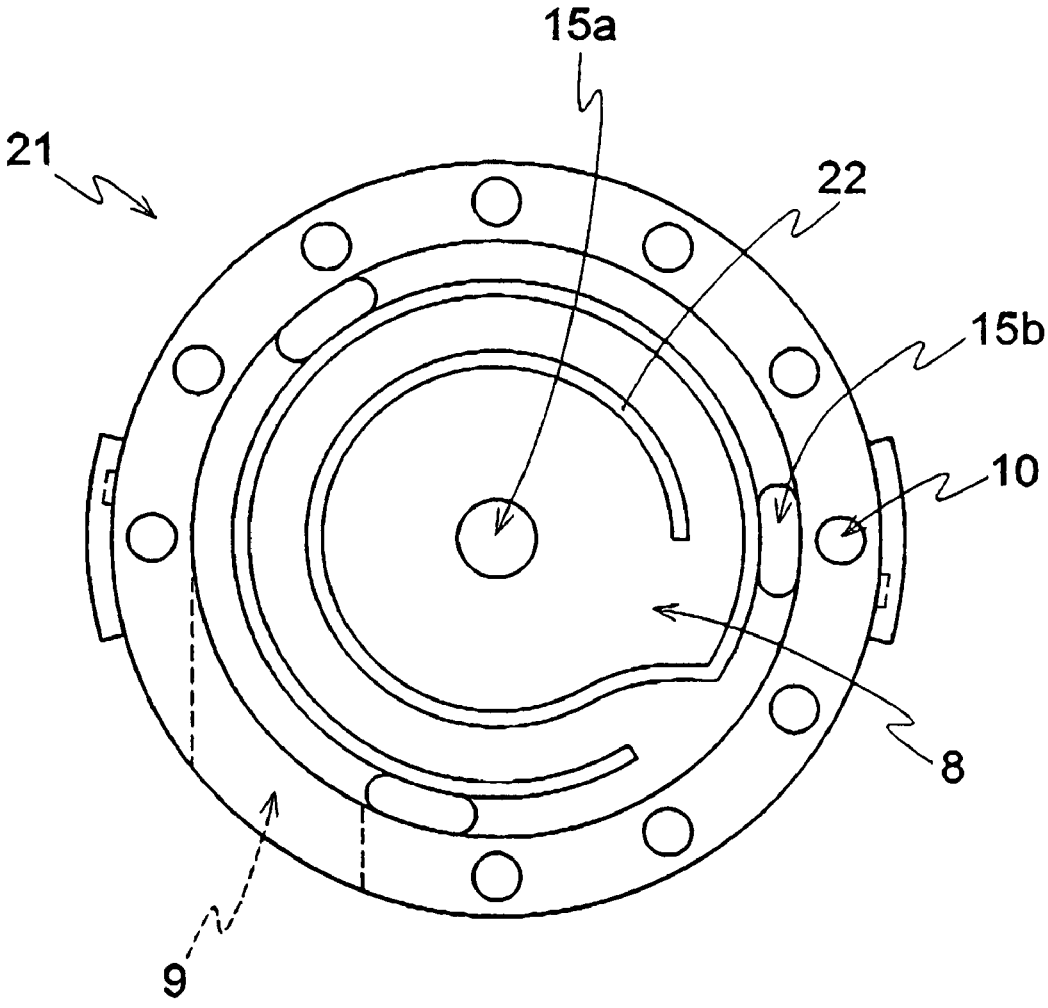
FIG. 6 is a plan view of the main body of the centrifugal dust collector of FIG. 5.

Embodiment 2 of the present invention is illustrated. In Embodiment 2, as shown in FIGS. 5 and 6, the generating portion of a cyclone generating portion 21 is composed of the conical portion 12 and the spiral separating wall 22.

In Embodiment 2, dust floating in the air circulation flow of the atmosphere sucked from the suction orifice 9 is separated from the air flow during movement at many times to the peripheral direction of the spiral separating wall 22 of the cyclone chamber 8 by the cyclone action and collected in the dust storing portion 5 from the central hole 15*a* and the outer peripheral hole 15*b*. Then, clean air is fed to the pump chamber of the pump through the vent orifices 13, 10 and 16 from the inside of the conical portion 12.

Embodiment 3

Figure 7:
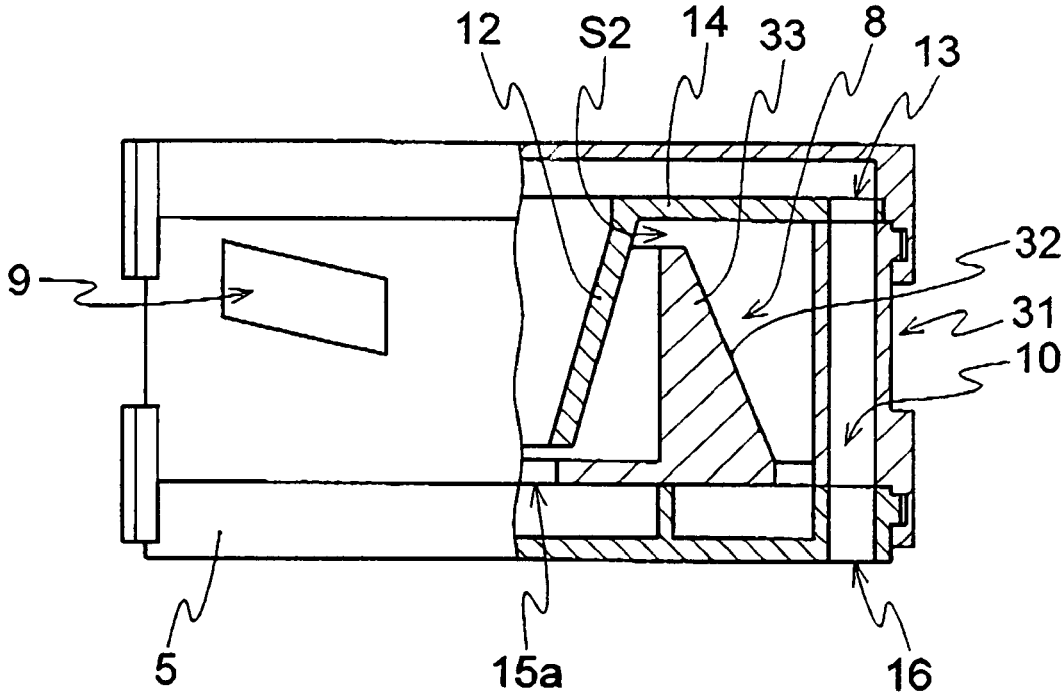
FIG. 7 is an essential sectional view showing the centrifugal dust collector related to Embodiment 3 of the present invention.
Figure 8:
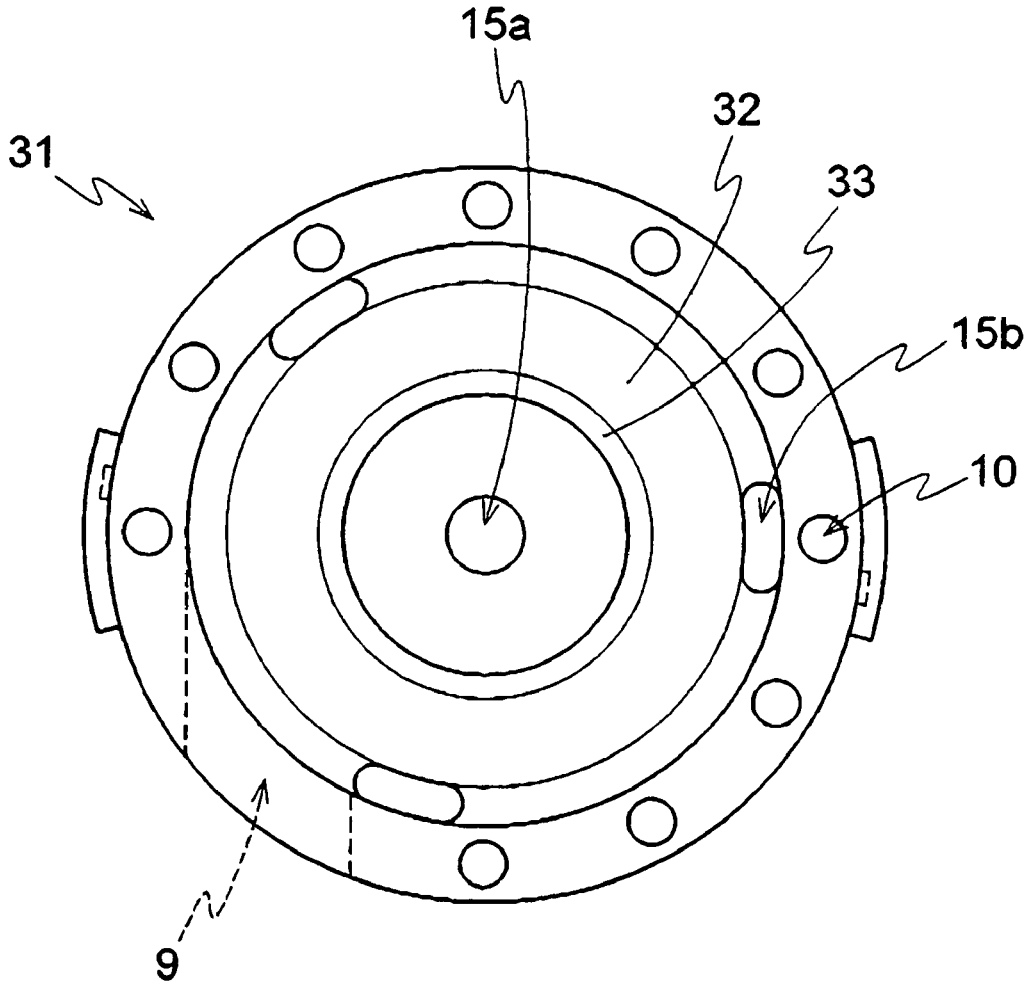
FIG. 8 is a plan view of the main body of the centrifugal dust collector of FIG. 7.

Embodiment 3 of the present invention is illustrated. In Embodiment 3, as shown in FIGS. 7 and 8, the generating portion of a cyclone generating portion 31 is composed of the conical portion 12 and the columnar separating wall 33 in which a taper 32 is formed at the external one face.

In Embodiment 3, dust floating in the air circulation flow of the atmosphere sucked from the suction orifice 9 is separated from the air flow at a lower portion side having a high flow rate during movement along the outer periphery of the columnar separating wall 33 of the cyclone chamber 8 by the cyclone action and collected in the dust storing portion 5 from the outer peripheral hole 15*b*. Further, when air which passed the gap S2 between said separating wall 33 and a partitioning plate 14 from the upper portion of the columnar separating wall 33 passes in the conical portion 12 while being rotated between the conical portion 12 and the separating wall 33 by the second cyclone action, fine dust is collected in the dust storing portion 5 from the central hole 15*a*. As a result, air with high cleanliness is fed to the pump chamber of the pump through the vent orifices 13, 10 and 16 from the inside of the conical portion 12.

Embodiment 4

Figure 9:
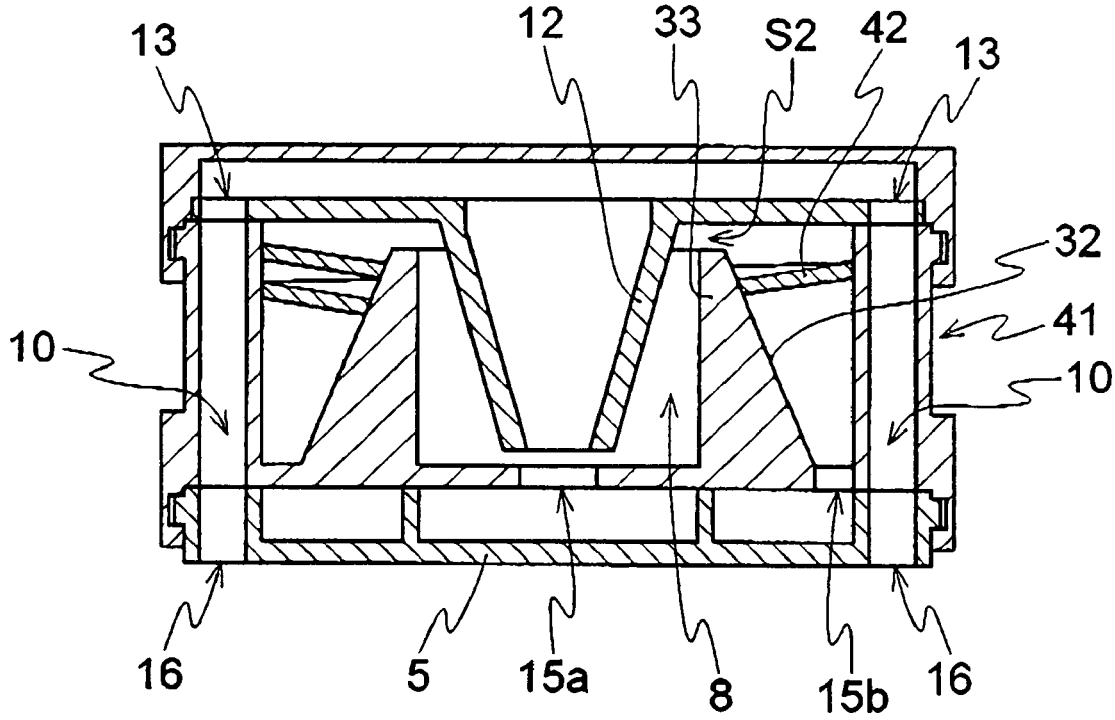
FIG. 9 is an essential sectional view showing the centrifugal dust collector related to Embodiment 4 of the present invention.
Figure 10:
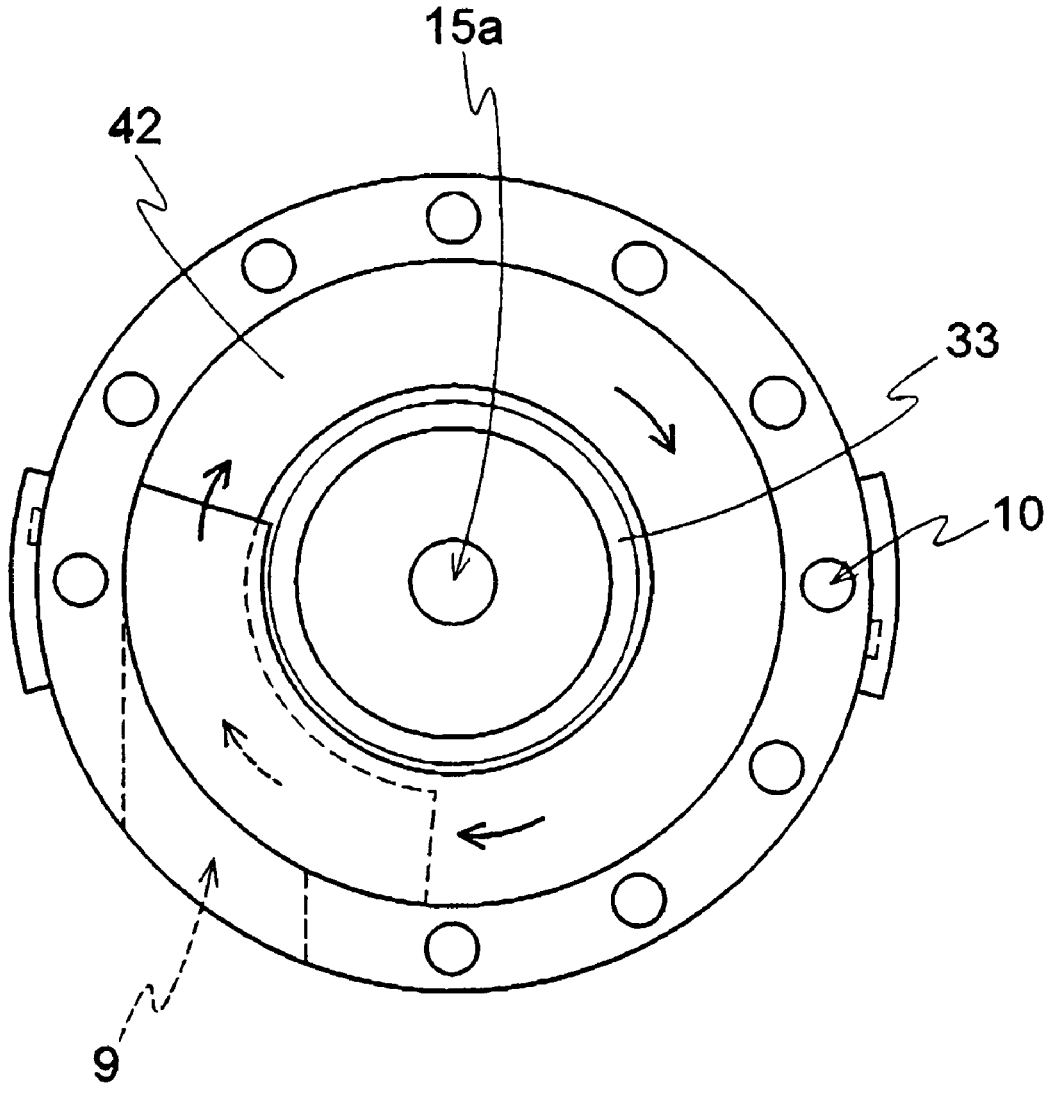
FIG. 10 is a plan view of the main body of the centrifugal dust collector of FIG. 9.

Embodiment 4 of the present invention is illustrated. In Embodiment 4, as shown in FIGS. 9 and 10, the generating portion of a cyclone generating portion 41 is composed of the conical portion 12, the columnar separating wall 33 in which a taper 32 is formed at the external one face, and a spiral plate 42 which is arranged between the separating wall 33 and the above-mentioned cyclone generating portion 41. The winding number of the spiral plate 42 can be suitably selected according to the size of the cyclone chamber 8 and the separating wall 33, but it can be also, for example, 1.5 windings (round). Further, in FIG. 9, the arrow mark shows the flow of air.

In Embodiment 4, since the spiral plate 42 is additionally added to the generating portion in the above-mentioned mode 3 of operation, dust floating in the air circulation flow of the atmospheresucked from the suction orifice 9 is separated from the air flow during movement to a peripheral direction by the spiral air flow caused by the spiral plate. 42 together with the cyclone action which is generated around the separating wall 33 of the cyclone chamber 8, and collected in the dust storing portion 5 from the outer peripheral hole 15*b*. Further, when air, which passed the gap S2 between the separating wall 33 and the partitioning plate 14 from the upper portion of the columnar separating wall 33, passes in the conical portion 12 while being rotated between the conical portion 12 and the separating wall 33 by the second cyclone action, and fine dust is collected in the dust storing portion 5 from the central hole 15*a*. As a result, air with high cleanliness is fed to the pump chamber of the pump through the vent orifices 13, 10 and 16 from the inside of the conical portion 12.

Then, with respect to the electromagnetic vibrating pumps related to the above-mentioned Embodiments 2 to 4, there was carried out a dust collecting test in which 30 g of diatom (fine sands) was absorbed from the suction orifice of each of centrifugal dust collectors in a condition in which the pump was operated for 10 minutes. Then, the pump was stopped after 10 minutes and the amount (dust collecting rate) of the diatom which was collected in the dust storing portion was tested. As a result, since the amounts (dust collecting rate) of the diatom were 26 to 28 g (87 to 93%), it was grasped that high dust collecting effect is obtained.

Embodiment 5

Figure 11:
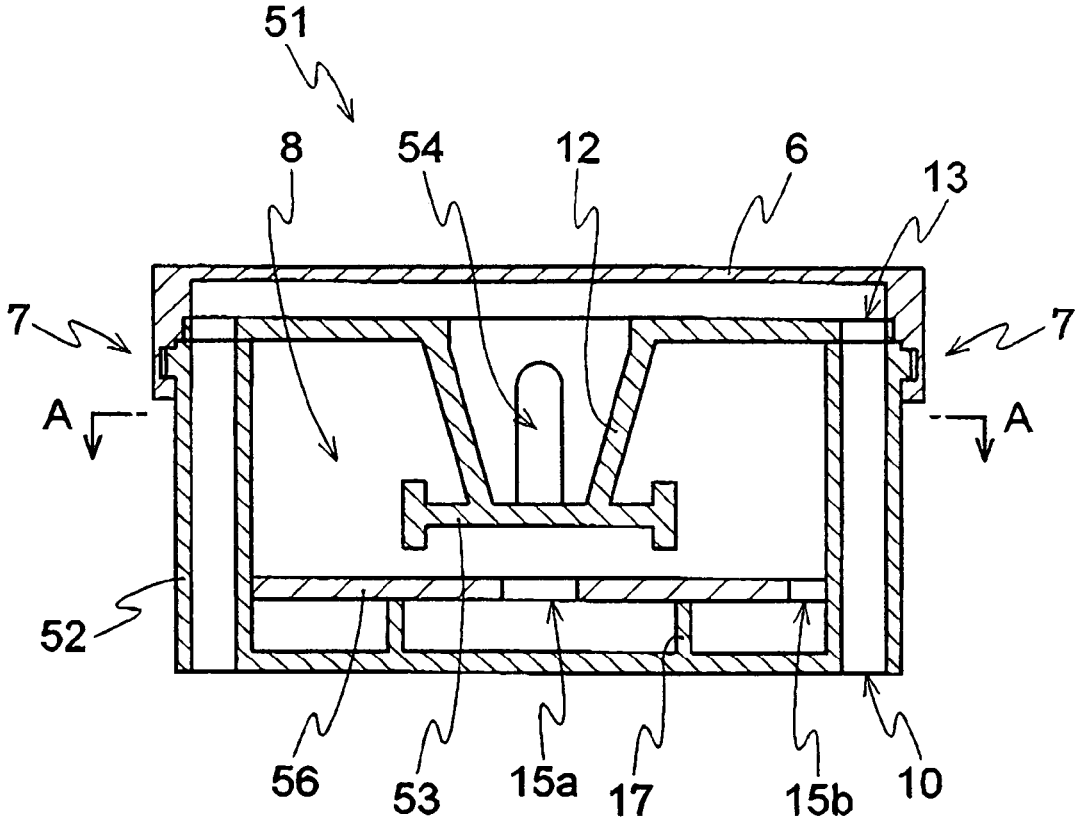
FIG. 11 is a sectional view showing the centrifugal dust collector related to Embodiment 5 of the present invention.
Figure 12:
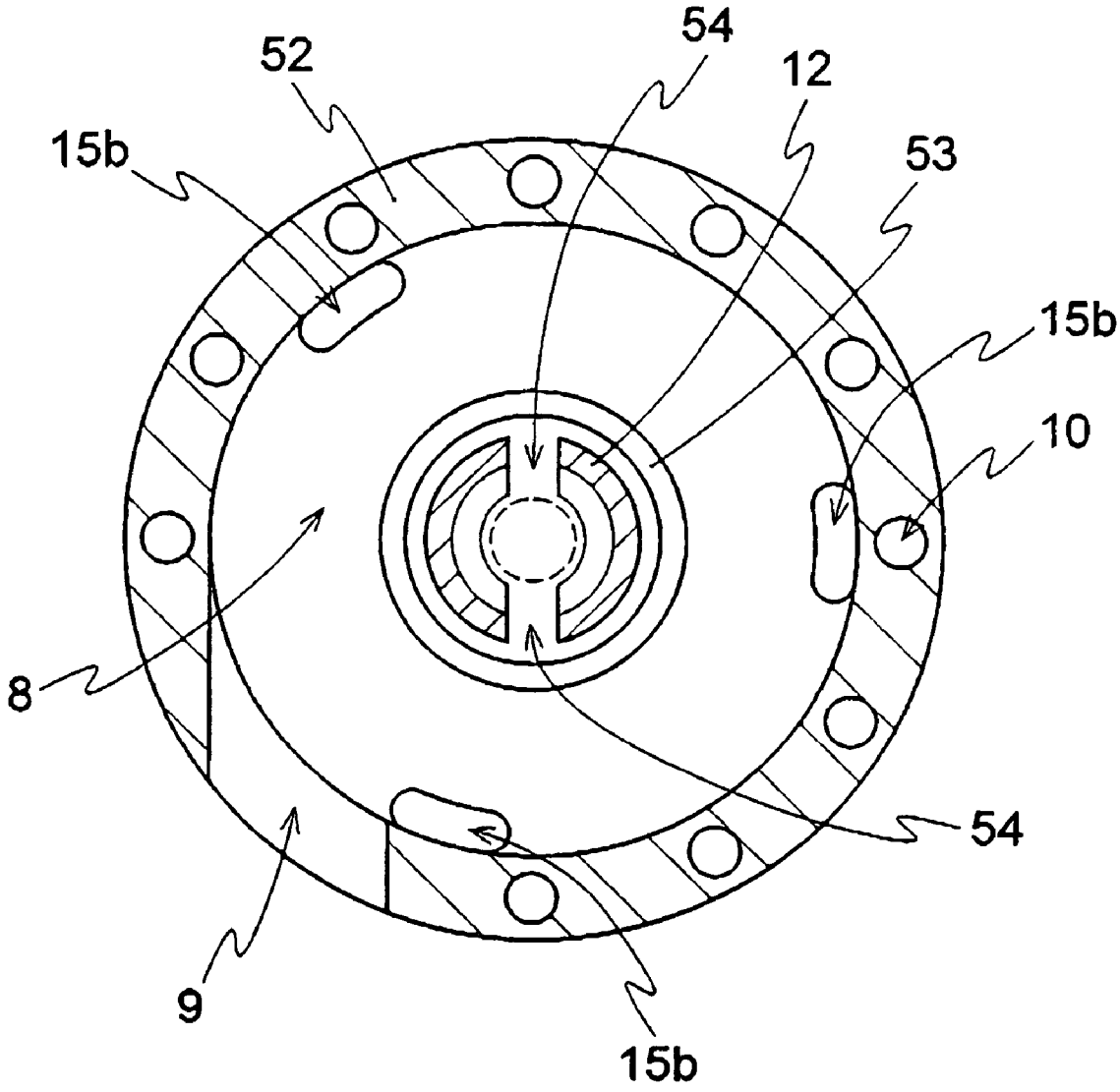
FIG. 12 is a sectional view taken along A-A line of FIG. 11.

Embodiment 5 of the present invention is illustrated. In Embodiment 5, as shown in FIGS. 11 and 12, a centrifugal dust collector 51 is composed of a cyclone generating portion 52 and an upper cover 6 which is provided at the upper portion of the cyclone generating portion 52. The cyclone generating portion 52 and the upper cover 6 are detachably provided by the fitting portion 7. A shielding plate 53 whose section is such as an H-shape is horizontally provided at the edge of the conical portion 12 which is the generating portion of the cyclone generating portion 52. Further, a pair of ventilation holes (slit) 54 which are linked with the vent hole 10 are formed facing each other at the outer periphery of the conical portion 12. A suitable number of the slits 54 can be formed in the present invention, but at least one may be formed. In Embodiment 5, since the dust storing portion is integrally formed at the bottom portion of the cyclone generating portion 52, a separating plate 56 in which at least one of holes 15*a* and 15*b* being linked to the dust storing portion is arranged.

Further, in Embodiment 5, the dust storing portion is formed at the bottom portion of the above-mentioned cyclone generating portion 52. However, in the present invention, it can be separately provided in the same manner as Embodiments hitherto. Further, although a columnar rib 17 is formed at the dust storing portion which is formed at the bottom portion of the above-mentioned cyclone generating portion 52, it can be omitted in the present invention.

In Embodiment 5, dust floating in the air circulation flow of the atmosphere sucked from the suction orifice 9 is separated in acceleration from the air flow by hitting the shielding plate 53 during movement to the peripheral direction of the cyclone chamber 8 by the cyclone action and collected in the dust storing portion from the outer peripheral hole 15*b* and the central hole 15*a*. As a result, clean air is fed to the pump chamber of the pump 1 through the vent orifices 13 and 10 from the slit 54 of the conical portion 12.

Embodiment 6

Figure 13:
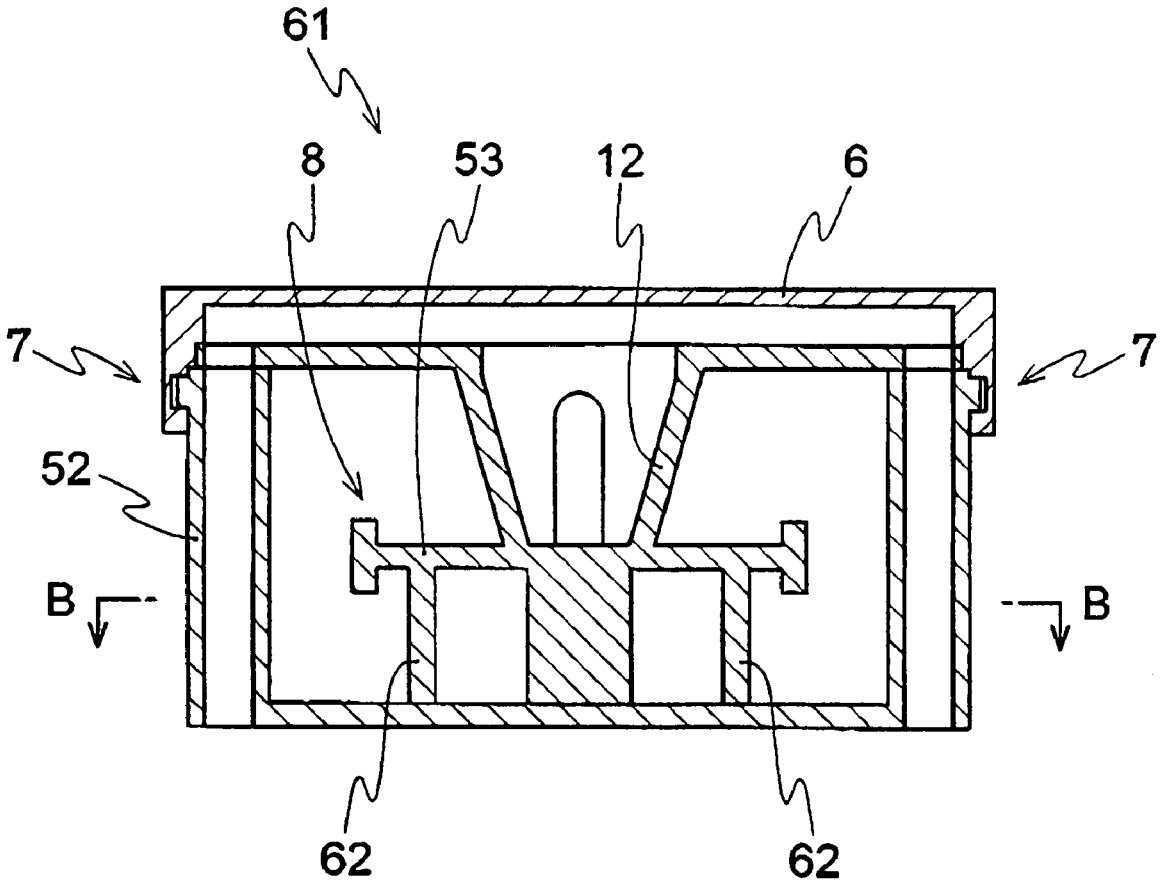
FIG. 13 is a sectional view showing the centrifugal dust collector related to Embodiment 6 of the present invention.
Figure 14:
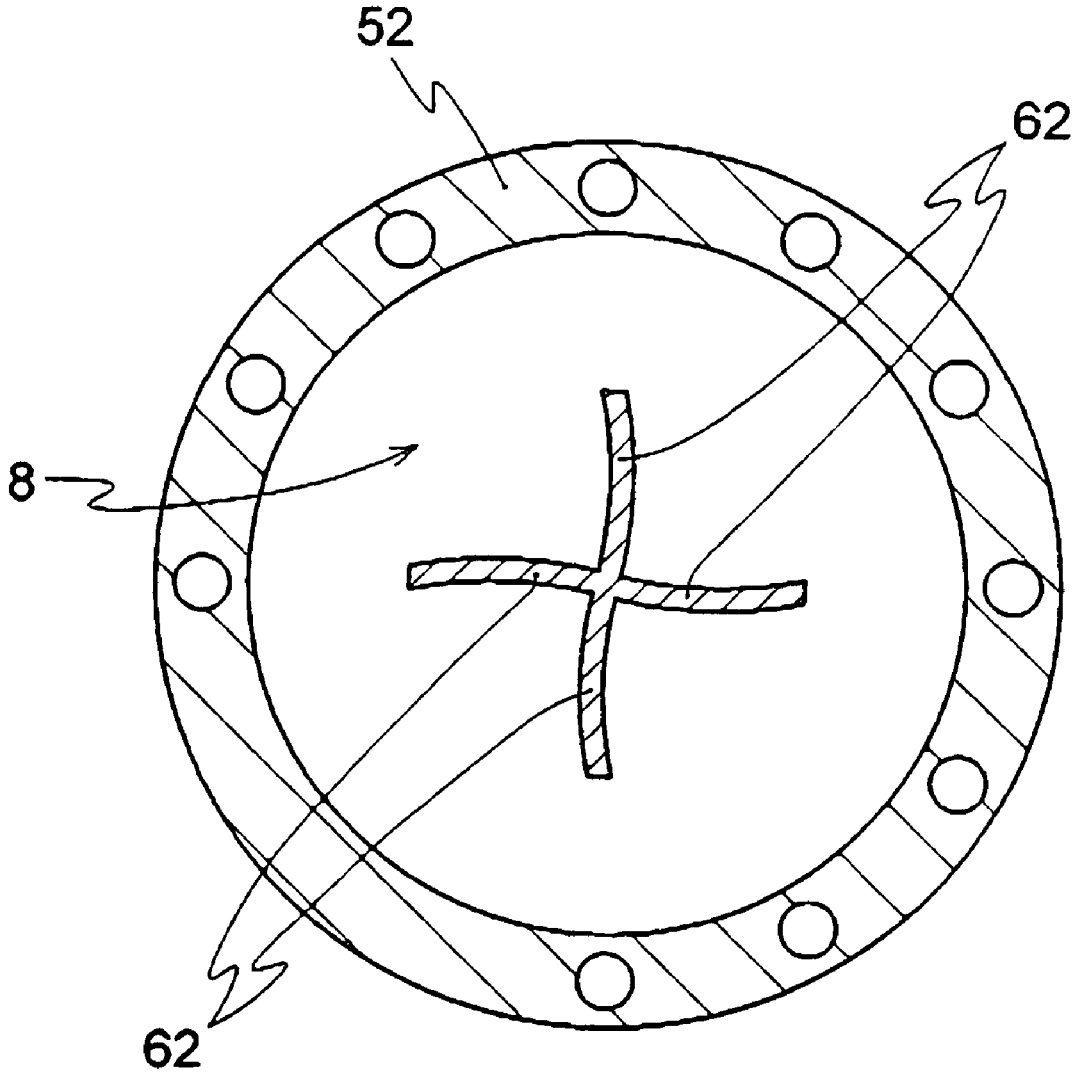
FIG. 14 is a sectional view taken along B-B line of FIG. 13.

Embodiment 6 of the present invention is illustrated. In Embodiment 6, as shown in FIGS. 13 and 14, a centrifugal dust collector 61 is composed of the above-mentioned cyclone generating portion 52 and an upper portion cover 6 of said cyclone generating portion 52. The cyclone generating portion 52 and the upper portion cover 6 are detachably provided by the fitting portion 7. A shielding plate 53 is formed at the edge of the conical portion 12 of the cyclone generating portion 52 in the same manner as the above-mentioned Embodiment 6 and further, a shielding wall 62 hangs at its lower portion. The shape, direction and number of the shielding wall 62 can be suitably selected, but in Embodiment 6, it is formed in an R-shape (curve shape) toward the revolving air flow and 4 sheets are formed in a cross shape.

In Embodiment 6, dust floating in the atmosphere which is sucked in the cyclone chamber 8 is separated by colliding with the shielding plate 53 through the shielding wall 62 without decreasing the suction power in the same manner as Embodiment.

Further, in the present invention, Embodiments hitherto can be appropriately used in combination.

Embodiment 7

Figure 15:
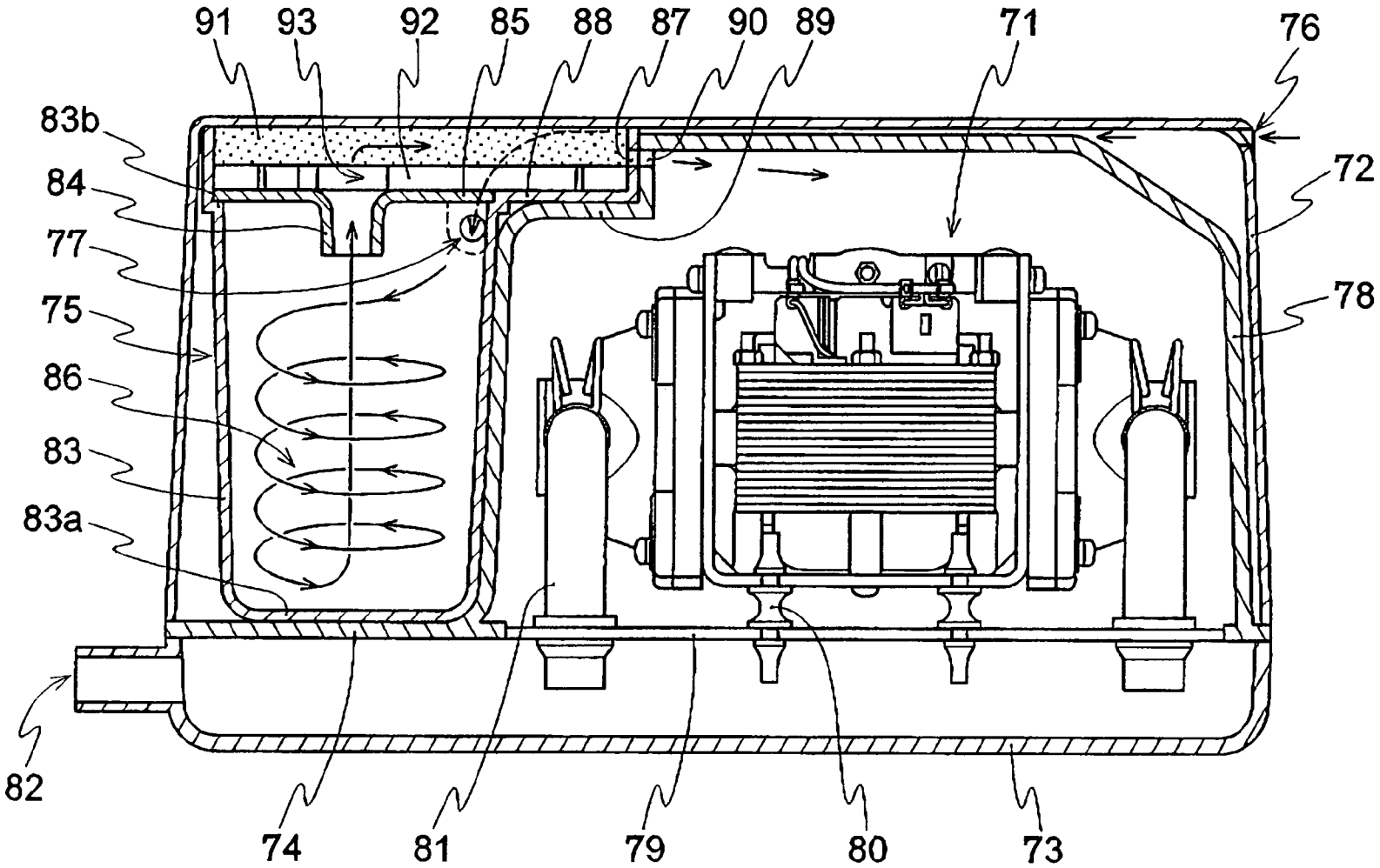
FIG. 15 is a sectional view showing the electromagnetic vibrating pump related to Embodiment 7 Embodiment 7 of the present invention.
Figure 16:
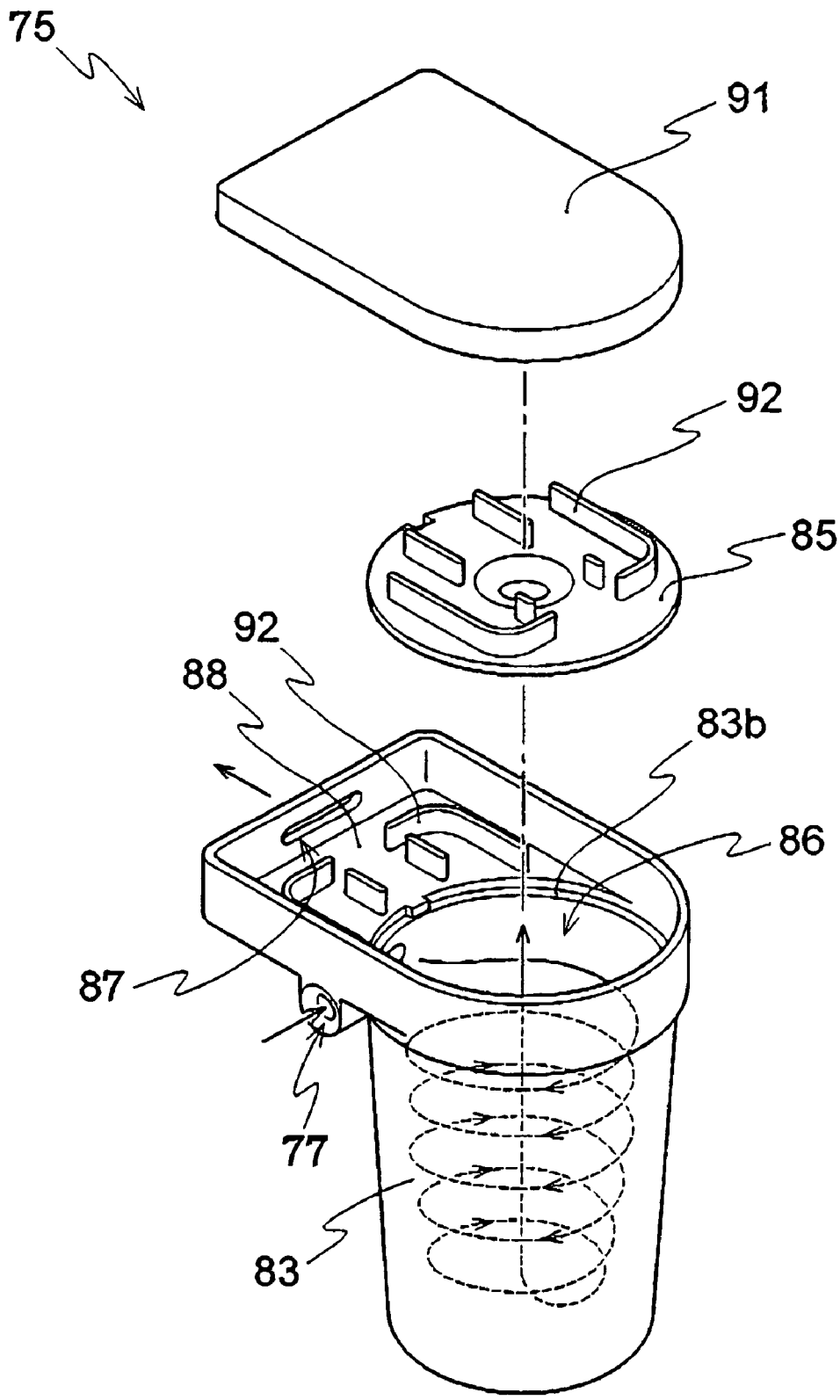
FIG. 16 is an exploded perspective view of the centrifugal dust collector of FIG. 15.

The pump related to Embodiment 7 is assembled by layering a pump frame body 72 with a bottom which stores a pump main body 71, an air tank 73 which functions as a silencer, a pump partitioning plate 74 which is provided between the above-mentioned pump frame body 72 and the air tank 73, and a centrifugal dust collector 75, as shown in FIGS. 15 and 16. Further, a pump cover 78 is formed at the above-mentioned pump partitioning plate 74 so as to secure a passage from a pump suction orifice 76 to the suction orifice 77 of the above-mentioned centrifugal dust collector 75 and cover the above-mentioned pump main body 71. The pump main body 71 is supported with a retaining plate 79 through a cushion 80 with a stage. Accordingly, the pump partitioning plate 74 and the retaining plate 79 are designed to be assembled by a separate body so that the above-mentioned pump main body 71 is covered with the pump cover 78. Further, in FIG. 15, Numeral 81 are hoses which introduce air discharged from the pump main body 71 to the air tank 73 and 82 is a discharge orifice which discharges air to an air bag such as, for example, an air mat.

The Embodiment 7 is different from the above-mentioned Embodiments 1 to 6 in that the centrifugal dust collector 75 is provided in combination with the pump main body 71 inside the pump frame body 72, and dust is collected in the main body 83 which is the generating portion of the cyclone generating portion in said centrifugal dust collector 75 (namely, the dust storing portion is not provided).

The above-mentioned main body 83 has a shape with a bottom for collecting dust inside, and a partitioning plate 85 having a columnar portion 84, which is a ventilation orifice, is covered on the opening portion 83*b* of the main body 83. The partitioning plate 85 is made with such as a synthetic resin or a synthetic rubber and has a role of a seal material for making a cyclone chamber 86 be a sealed condition as well. Further, the position of a suction orifice 77, which is formed at the above-mentioned main body 83, is preferably located at upper side than the edge of the above-mentioned columnar portion in order to enhance the dust collecting effect through dropping dust being sucked on the upper portion of the cyclone chamber 86 on the bottom portion 83*a* of the main body 83 by cyclone action. Further, it is preferable that the whole or the portion of outer periphery of the above-mentioned pump frame body 72 and the main body 83 is made of a transparent or semi-transparent material in order to be able to externally confirm the amount of dust collected on the bottom portion 83*a*.

An overhang portion 88 in which a vent orifice 87 (an air feed orifice to the pump main body 71) is formed in horizontal direction from the portion of the surrounding portion of the above-mentioned opening portion 83*b*. The overhang portion 88 is installed on the stage portion 89 of the above-mentioned pump cover 78 to hold the centrifugal dust collector 75 in stability. An air feed orifice 90 to the pump main body 71 which is linked with the above-mentioned vent orifice 87 is formed at the peripheral wall of the stage portion 89. Further, a filter 91 which is made of, for example, a non-woven cloth and can remove fine dust is provided at the above-mentioned partitioning plate 85 and overhang portion 88 through a plural number of columns 92.

Further, the above-mentioned filter 91 is provided through the plural number of columns 92 in order to be arranged at the partitioning plate 85 and the air tank 93 which is formed between the upper face of the overhang portion 88 and the pump frame body 72. However in the present invention, the filter 91 and the column 92 can be also omitted by installing a net for removing dust on the conical portion when a conical portion with a ventilation hole is used as the above-mentioned ventilation orifice. Further, the above-mentioned pump frame body 72 covers the upper portion of the above-mentioned filter 91, but in the present invention, an upper portion cover which is different from the pump frame body 72 can be also fit.

In Embodiment 7, as shown in FIG. 15, the atmosphere which was sucked from the pump suction orifice 76 for feeding air to the pump is introduced by the vibration of a vibrator in the pump main body 71 into the cyclone chamber 86 of the main body 83 through a passage inside of the pump frame body 72 from a suction orifice 77 to the cyclone chamber. Then, dust with a large size which floats in the circulation air flow is separated from the air flow during movement toward the peripheral direction of the cyclone chamber 86 by the cyclone action (centrifugal action) and collected on the bottom portion 83*a* of the main body 83. Then, fine dust in the atmosphere which passes the columnar portion 84 is removed during they pass a filter 92. As a result, clean air is fed to the pump chamber in the pump main body 71 through the vent orifice 87 and the air feed orifice 90.

Embodiment 8

Figure 17:
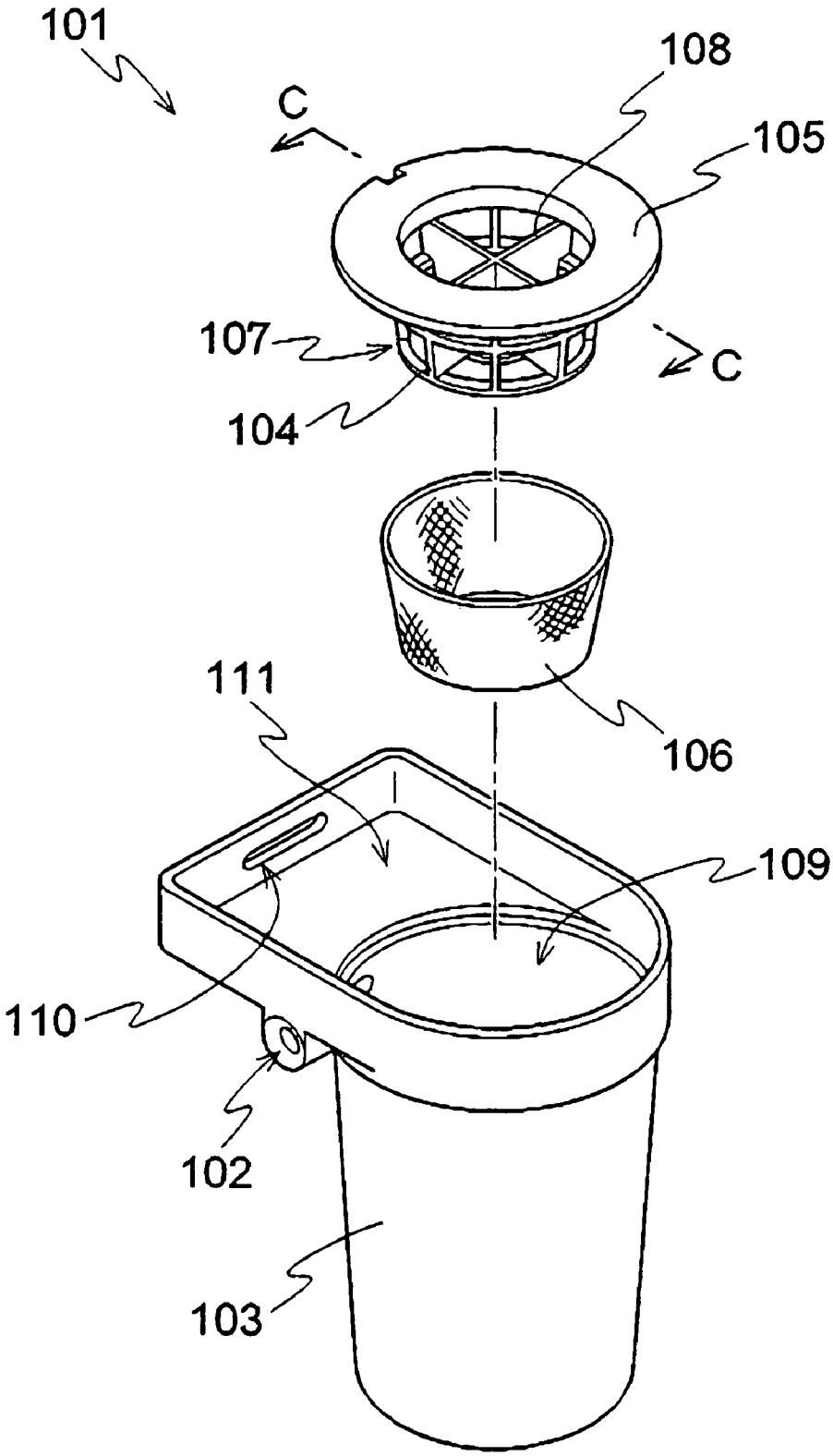
FIG. 17 is an exploded perspective view showing the centrifugal dust collector related to Embodiment 8 of the present invention.
Figure 18:
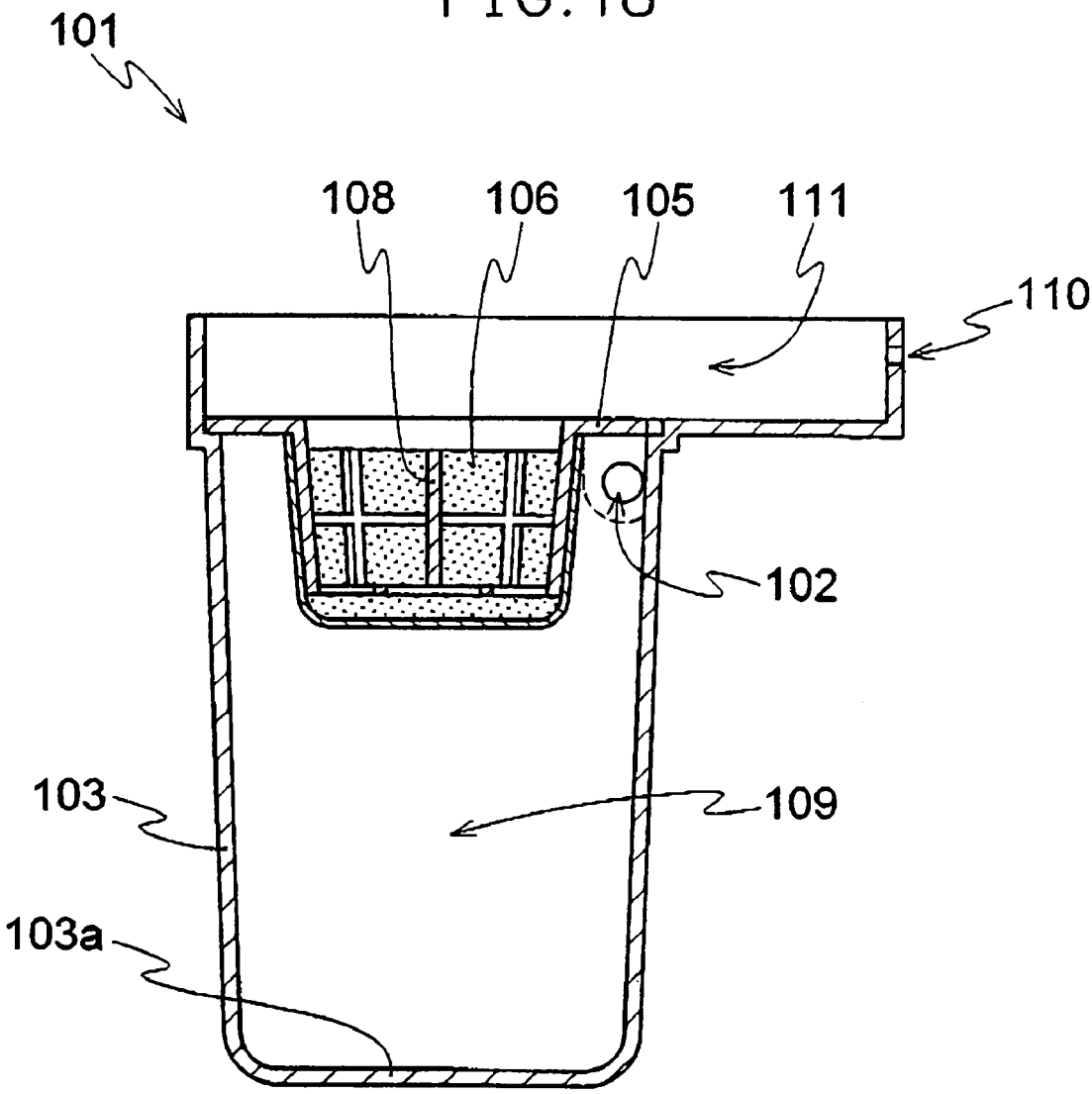
FIG. 18 is a sectional view taken along C-C line of the centrifugal dust collector of FIG. 17.

The present Embodiment 8 is different from the above-mentioned Embodiment 7 in the composition of a centrifugal dust collector. As shown in FIGS. 17 and 18, the centrifugal dust collector 101 in Embodiment 8 is composed of a main body 103 with a bottom which has a suction orifice 102, a partitioning plate 105 having a conical portion 104 and a net 106 which is installed on said conical portion 104. In the conical portion 104 in Embodiment 8, a plural number of ventilation holes 107 are formed at the outer periphery and a cross shape supporting portion 108 for reinforcement is formed in the inside, but in the present invention, the number of the above-mentioned ventilation holes 107 is not specifically limited and net shape (mesh shape) ventilation holes can be also used in place of the slit shape ventilation holes 107. Further, in FIG. 18, the section of the above-mentioned supporting portion 108 is omitted in order to show the inside to be easily understood.

The above-mentioned net 106 is installed for removing dust in the atmosphere which were sucked, and when it is detachable for the conical portion 104, its installation position can be either of the inner peripheral face or the outer peripheral face of the conical portion 104, or both faces of them. Further, as the installation structure of the net 106, a normal structure can be suitably selected, but for example, a convex portion is provided at the conical portion to be installed, or it is pushed with a ring made of an elastic body, for example, a belt made of a rubber, or there can be made a structure that it is installed by providing a certain intimate force or fastening force by which it is not peeled by vibration and the like. The mesh of the above-mentioned net 106 can be suitably selected because the size of dust in the atmosphere differs depending on the place of the pump used. For example, it can be #300 to 700.

In Embodiment 8, dust with a large size, which floats in the air circulation flow of the atmosphere introduced from a suction orifice 102 to the cyclone chamber 109 of the main body 103, is separated from the air flow during movement toward the peripheral direction of the cyclone chamber 109 by the cyclone action (centrifugal action) and collected on the bottom portion 103*a* of the main body 103. Then, fine dust in the atmosphere is removed during they pass the net 106. As a result, clean air is fed to the pump chamber in the pump main body through the conical portion 104 and the vent orifice 110.

Further, although the net 106 is installed on the conical portion 104 in Embodiment 8, it is not limited to this in the present invention. The net can be omitted and a filter can be also arranged at an air tank 111 which formed between the partitioning plate 105 and the pump frame body in like manner as the above-mentioned Embodiment 7. Further, it is preferable that the whole or the portion of outer periphery of the above-mentioned main body 103 is prepared from a transparent or semi-transparent material in order to be able to externally confirm the amount of dust collected on the bottom portion 103*a*.

Embodiment 9

Figure 19:
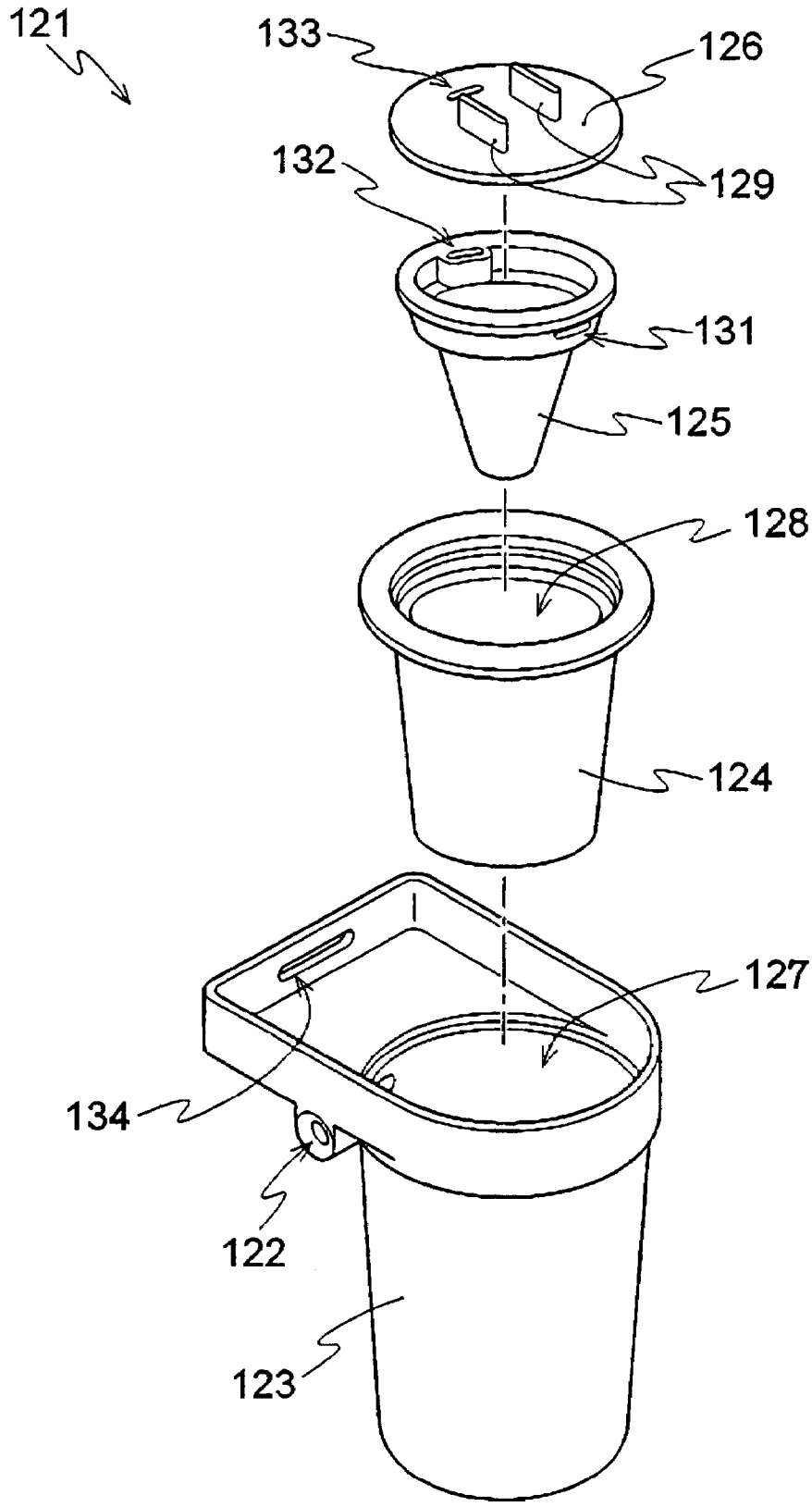
FIG. 19 is an exploded perspective view showing the centrifugal dust collector related to Embodiment 9 of the present invention.
Figure 20:
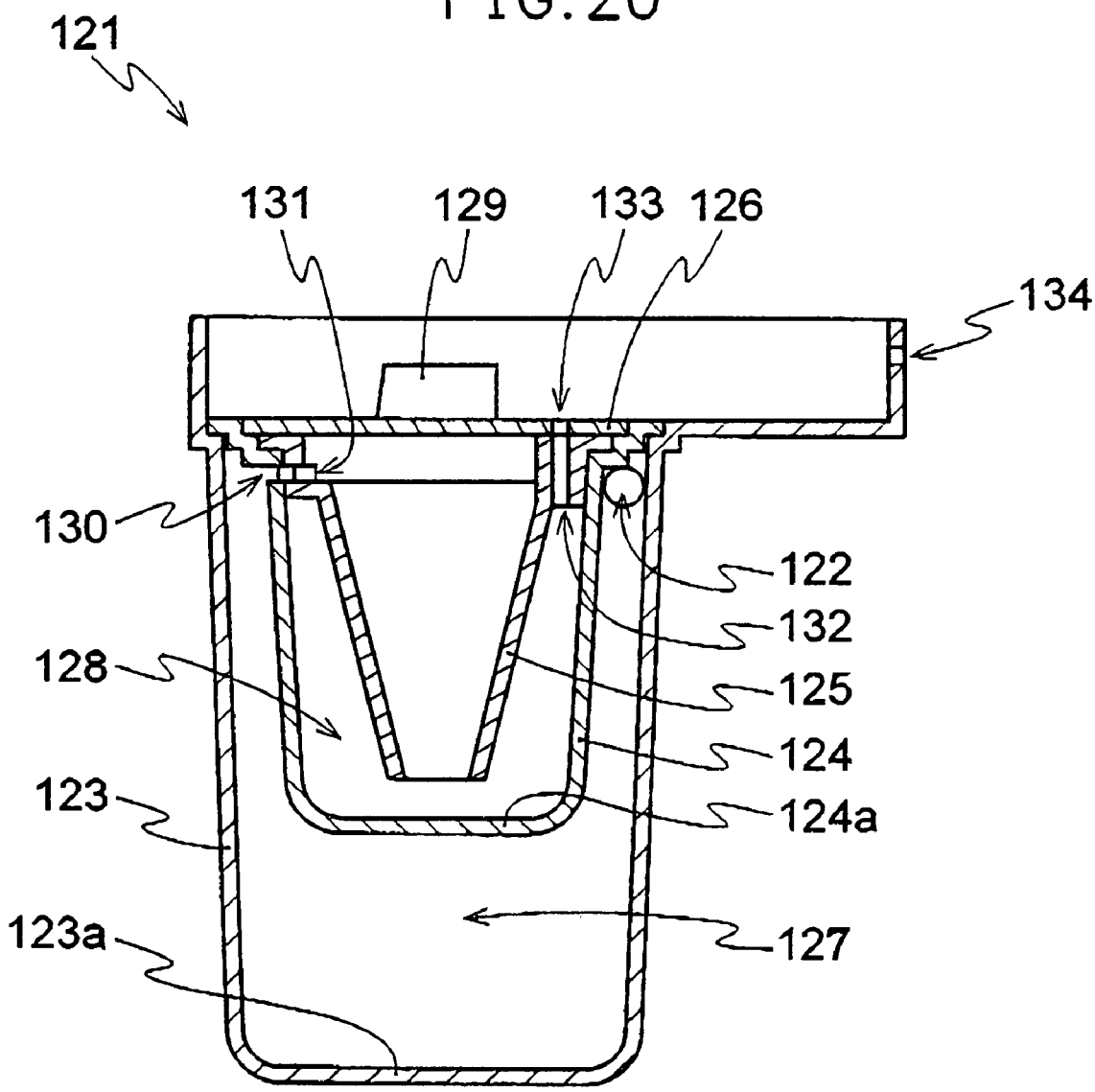
FIG. 20 is a sectional view of the centrifugal dust collector of FIG. 19.
Figure 21:
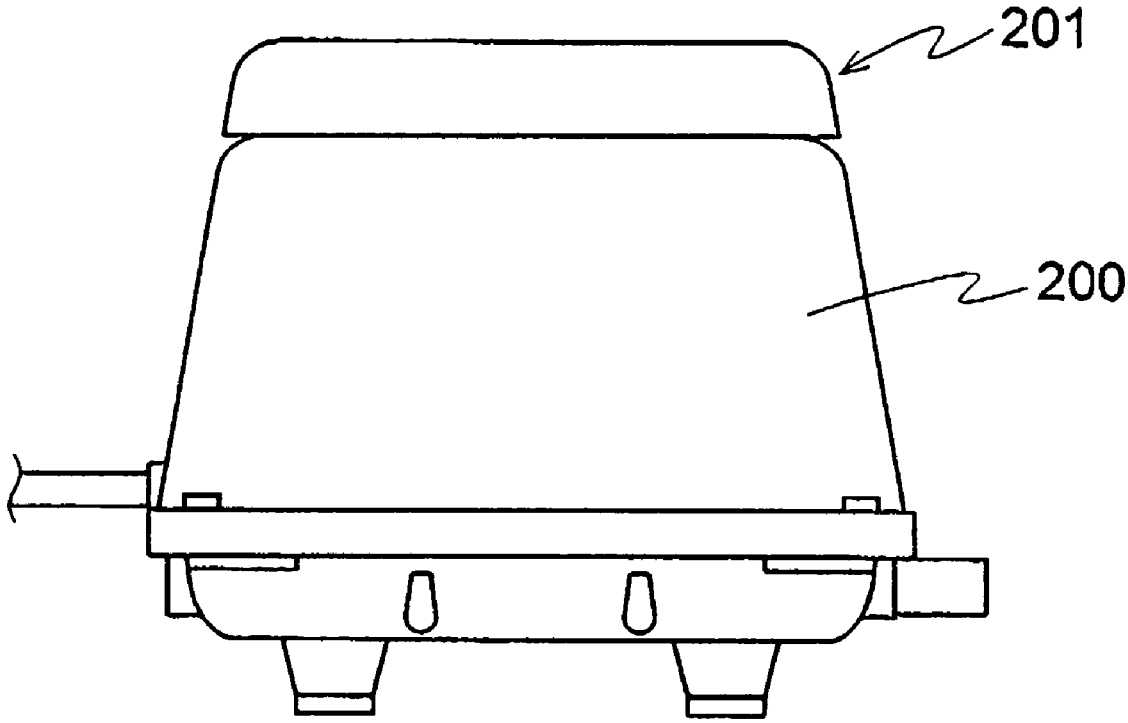
FIG. 21 is a side view showing a conventional pump.
Figure 22:
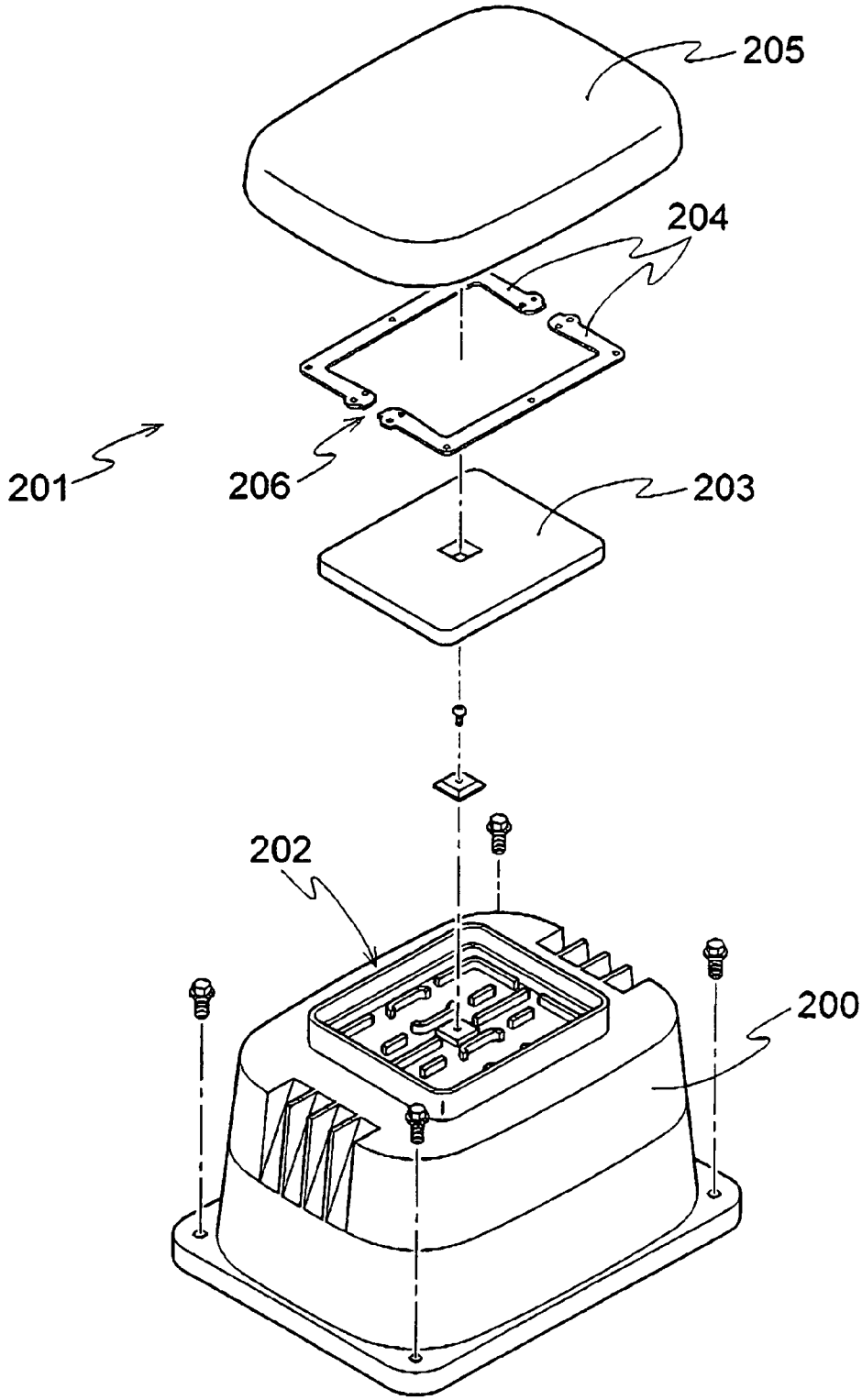
FIG. 22 is an exploded perspective view of the dust collector of FIG. 21.

As shown in FIGS. 19 and 20, the centrifugal dust collector 121 related to Embodiment 9 is composed of a main body 123 with a bottom which has a suction orifice 122, a wall separating column 124 with a bottom, a conical portion 125 being the second generating portion and a partitioning plate 105 which is covered on said wall separating column 124 and the conical portion 125. Namely, the centrifugal dust collector 121 related to Embodiment 9 has a double cyclone structure that the first cyclone chamber 127 is formed between the main body 123 and the wall separating column 124 and the second cyclone chamber 128 is formed between the wall separating column 124 and the conical portion 125. Further, in FIGS. 19 and 20, Numeral 129 are picking portions which were provided for easily treating the partitioning plate 126. Further, the whole or the portion of outer periphery of the above-mentioned main body 123 can be prepared from a transparent or semi-transparent material in order to be able to externally confirm the amount of dust collected on the bottom portion 123*a*. Further, since the arrangement in Embodiment 9 has the double cyclone type structure, a filter is not used but a filter can be provided at the upper portion of the above-mentioned main body 123 for further removing fine dust. Alternatively, a plural number of ventilation holes or net shape ventilation holes are formed at the outer periphery of the above-mentioned conical portion 125 and a net for removing dust can be detachably installed. Further, the arrangement in Embodiment 9 has the double cyclone type structure. However, in the present invention, the structure is not specifically limited to this, and it can be also a multiple cyclone type structure by applying a structure further providing a cyclone chamber.

In Embodiment 9, dust floating in the air circulation flow of the atmosphere introduced from a suction orifice 122 is separated from the air flow during movement upward by rising air flow caused by the wall separating column 124 together with the cyclone action which is generated around the wall separating column 124 of the cyclone chamber 127, and large size dust is collected on the bottom portion 123*a* of the main body 123. Then, when air which passed the first ventilation orifice 130 and the first ventilation orifice 131 being formed at the wall separating column 124 and the upper portion of the conical portion 125 is rotated by the second cyclone action between the wall separating column 124 and the conical portion 125 and passes the inside of the conical portion 125, fine dust is collected on the bottom portion 124*a* of the wall separating column 124. As a result, air with high cleanliness is fed to the pump chamber of the pump main body through the second ventilation orifice 132, a ventilation orifice 133 which is formed on a partitioning plate 126 and a vent orifice 134 from the conical portion 125.

Further, the electromagnetic vibrating pump has been illustrated in Embodiments hitherto, however it is not limited to these in the present invention, and it can be also applied to such as an electromagnetic vibrating piston pump.

INDUSTRIAL APPLICABILITY

As described above, according to the present invention, dust or sand dust in air of the atmosphere being sucked can be collected in a cyclone chamber with centrifugal force by the cyclone action. Further, since dust or sand dust which enters in a dust storing portion or on the bottom portion of a main body can be collected without being inversely flown into the cyclone chamber, thereby a dust collecting function can be enhanced. Accordingly, clean air can be fed to a pump chamber. Consequently, the number of times of the maintenance working of the pump can be reduced and the rate of operation can be improved.

What is claimed is:

1. An electromagnetic vibrating pump comprising:

a suction orifice sucking air;

vent orifices venting said air in an internal cyclone chamber; and a centrifugal dust collector including a cyclone generating portion provided with a generating portion for generating cyclone action to the atmosphere being sucked in the cyclone chamber through said suction orifice, wherein said centrifugal dust collector is composed of said cyclone generating portion, a dust storing portion which is provided at the lower portion of said cyclone generating portion and an upper portion cover which is provided at the upper portion of said cyclone generating portion.

2. The electromagnetic vibrating pump according to claim 1, wherein at least one of holes which are linked with said dust storing portion is formed at the bottom portion of said cyclone generating portion.

3. The electromagnetic vibrating pump according to claim 1 or 2, wherein said cyclone generating portion, said dust storing portion and the upper portion cover are detachably provided by an uneven fitting portion.

4. The electromagnetic vibrating pump according to claim 1 or 2, wherein said generating portion is composed of a conical portion and a spiral separating wall.

5. The electromagnetic vibrating pump according to claim 1 or 2, wherein said generating portion is composed of a conical portion and a columnar separating wall in which a taper is formed at one external side face.

6. The electromagnetic vibrating pump according to claim 1 or 2, wherein said generating portion is composed of a conical portion a columnar separating wall in which a taper is formed at one external side face and a spiral plate which is arranged between the separating wall and said cyclone generating portion. wall.

7. An electromagnetic vibrating pump comprising:

a suction orifice sucking air;

vent orifices venting said air in an internal cyclone chamber; and a centrifugal dust collector including a cyclone generating portion provided with a generating portion for generating cyclone action to the atmosphere being sucked in the cyclone chamber through said suction orifice, wherein said centrifugal dust collector is composed of said cyclone generating portion and an upper portion cover which is provided at the upper portion of said cyclone generating portion.

8. The electromagnetic vibrating pump according to claim 7, wherein a dust storing portion is formed at the bottom portion of said cyclone generating portion and a separating plate in which at least one of holes being linked with the dust storing portion is arranged.

9. The electromagnetic vibrating pump according to claim 1, 2 or 8, wherein a columnar rib is provided at the inner face of the bottom portion of said dust storing portion.

10. The electromagnetic vibrating pump according to claim 7 or 8, wherein said cyclone generating portion and the upper portion cover are detachably provided by the uneven fitting portion.

11. The electromagnetic vibrating pump according to claim 7 or 8, wherein said generating portion is a conical portion in which at least one of windows is formed at the outer periphery and a shielding plate which is formed at the edge of the conical portion is provided.

12. The electromagnetic vibrating pump according to claim 11, wherein a shielding wall hanging down is provided at the lower portion of said shielding wall.

13. The electromagnetic vibrating pump according to claim 1, 2, 7 or 8, wherein said suction orifice is formed at the upper position of the cyclone chamber.

14. The electromagnetic vibrating pump according to claim 1, 2, 7 or 8, wherein said suction orifice is formed at the lower position of the cyclone chamber.

15. The electromagnetic vibrating pump according to claim 1, 2, 7 or 8, wherein the opening shape of said suction orifice is a nearly rectangular shape or a nearly long circular shape and slanted so that an opening sectional area is reduced toward the cyclone chamber.

16. The electromagnetic vibrating pump according to claim 1, 2, 7 or 8, wherein the vent orifice of said cyclone generating portion is linked with the a pump frame body of an electromagnetic vibrating pump.

* * * * *